US008505130B2

(12) United States Patent
Wang et al.

(10) Patent No.: US 8,505,130 B2
(45) Date of Patent: Aug. 13, 2013

(54) BATH APPARATUS

(76) Inventors: Zhongxian Wang, Qingdao (CN); Hanlin Wang, Qingdao (CN)

( * ) Notice: Subject to any disclaimer, the term of this patent is extended or adjusted under 35 U.S.C. 154(b) by 0 days.

(21) Appl. No.: 13/561,622

(22) Filed: Jul. 30, 2012

(65) Prior Publication Data

US 2013/0014323 A1 Jan. 17, 2013

Related U.S. Application Data

(63) Continuation-in-part of application No. PCT/CN2011/073989, filed on Jul. 11, 2011.

(51) Int. Cl.
*A47K 3/00* (2006.01)

(52) U.S. Cl.
USPC ..... 4/612; 4/613; 4/614

(58) Field of Classification Search
USPC ..... 4/596, 612–614
See application file for complete search history.

(56) References Cited

U.S. PATENT DOCUMENTS

| | | | | |
|---|---|---|---|---|
| 4,337,540 | A * | 7/1982 | Lindeman | 4/612 |
| 7,073,214 | B2 * | 7/2006 | Pastorelli | 4/614 |

FOREIGN PATENT DOCUMENTS

| | | |
|---|---|---|
| CN | 1891124 | 1/2007 |
| CN | 101856203 | 10/2010 |
| CN | 201734618 | 2/2011 |
| DE | 19710775 | 9/1998 |
| JP | 5-33508 | 2/1993 |

* cited by examiner

*Primary Examiner* — Tuan N Nguyen
(74) *Attorney, Agent, or Firm* — Hamre, Schumann, Mueller & Larson, P.C.

(57) ABSTRACT

A bath apparatus or a shower machine includes a housing and a showerhead mounted therein. The housing includes a door opening where a door body is installed. The housing has an egg-shell shape with the door opening provided at a front side and a back panel provided at a rear side. A slide rail fixedly connected to an inside wall of the housing, extends from a rear end that is fixed to the back panel to a front end at the door opening. The front end of the slide rail includes a locking clip body that matches a locking clip socket fixed on the housing. A sliding block is installed on the slide rail and fixedly connected to a supporting rod. A top end of the supporting rod is hinge jointed to the door body.

4 Claims, 6 Drawing Sheets

BATH APPARATUS

This application is a continuation-in-part application of PCT/CN2011/073989, filed Jul. 11, 2011, which is incorporated herein by reference in its entirety.

FIELD

This disclosure relates to a personal care apparatus, more particularly, a bath apparatus.

BACKGROUND

Existing bath or shower apparatuses are water consuming, space occupying and also exhausting for people who take the bath or shower. A shower cubicle can use a relatively smaller space, but it cannot solve the problem regarding the water consuming and exhausting issue. In addition, the current available shower cubicle can provide a shower, but not able to provide a bath. A bathtub or bathroom can provide a bath, but they are too spacious and water consuming.

SUMMARY

The projective of embodiments described herein is to provide a space-efficient and water-efficient bath apparatus that has functions of auto showering and auto bathing.

In one embodiment, a bath apparatus includes a housing and a showerhead installed inside the housing. A opening is provided on the housing and a door is mounted thereon. The housing is an egg-shell shape. The opening is disposed at a front end of the housing. A rear panel is disposed at a rear end of the housing. A slide rail is disposed at an inner side of the housing. A rear end of the slide rail is fixedly connected to the rear panel. A front end of the slide rail extends to the opening of the housing and includes a locking clip body. A locking clip socket is fixedly mounted on the housing and the locking clip socket matches the locking clip body. A slide block is mounted on the slide rail. The slide block is fixedly connected to a supporting rod. A top end of the supporting rod is hinge-jointed to the door.

A strengthening rib is embedded into a waist portion of the housing. The strengthening rib horizontally surrounds the housing except for the opening. The strengthening rib is connected to the rear end of the slide rail at the rear panel. The locking clip socket is fixedly connected to the strengthening rib.

A base is disposed at a lower end of the housing. The base includes a water storage, one or more supporting legs inserted into a bottom plate of the water storage, and a water-leaking panel mounted on the supporting legs. An upper end of the supporting legs is disposed inside the water storage and includes a end cap capable of adjusting the height of the legs. The water-leaking panel is disposed on the end cap.

A filter is fixedly mounted under the water-leaking panel. The filter includes a water-collecting funnel connected to a filter element underneath the water-leaking panel.

The filter element includes a tubular filter body, a filter cover mounted on an upper end of the filter body, and a sieve mounted inside the filter body. One or more drainage openings are disposed on a sidewall of the filter body.

The upper end of the supporting legs includes external screw threads. The end cap and the supporting legs are threadedly connected.

The bath apparatus described herein is water-efficient, capable of recycling water, auto-showering, and bathing, as well space-efficient.

DRAWINGS

DETAILED EMBODIMENTS

Figure 1:
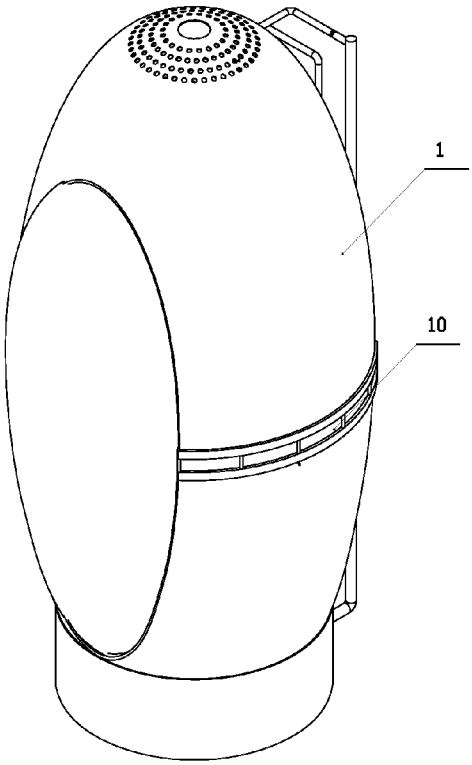
FIG. 1 illustrates a schematic view of one embodiment.
Figure 2:
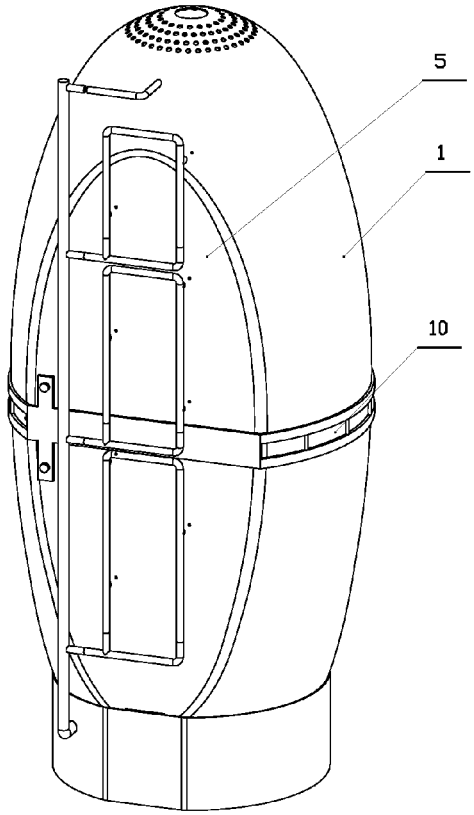
FIG. 2 illustrates a back side view of the embodiment of FIG. 1.
Figure 3:
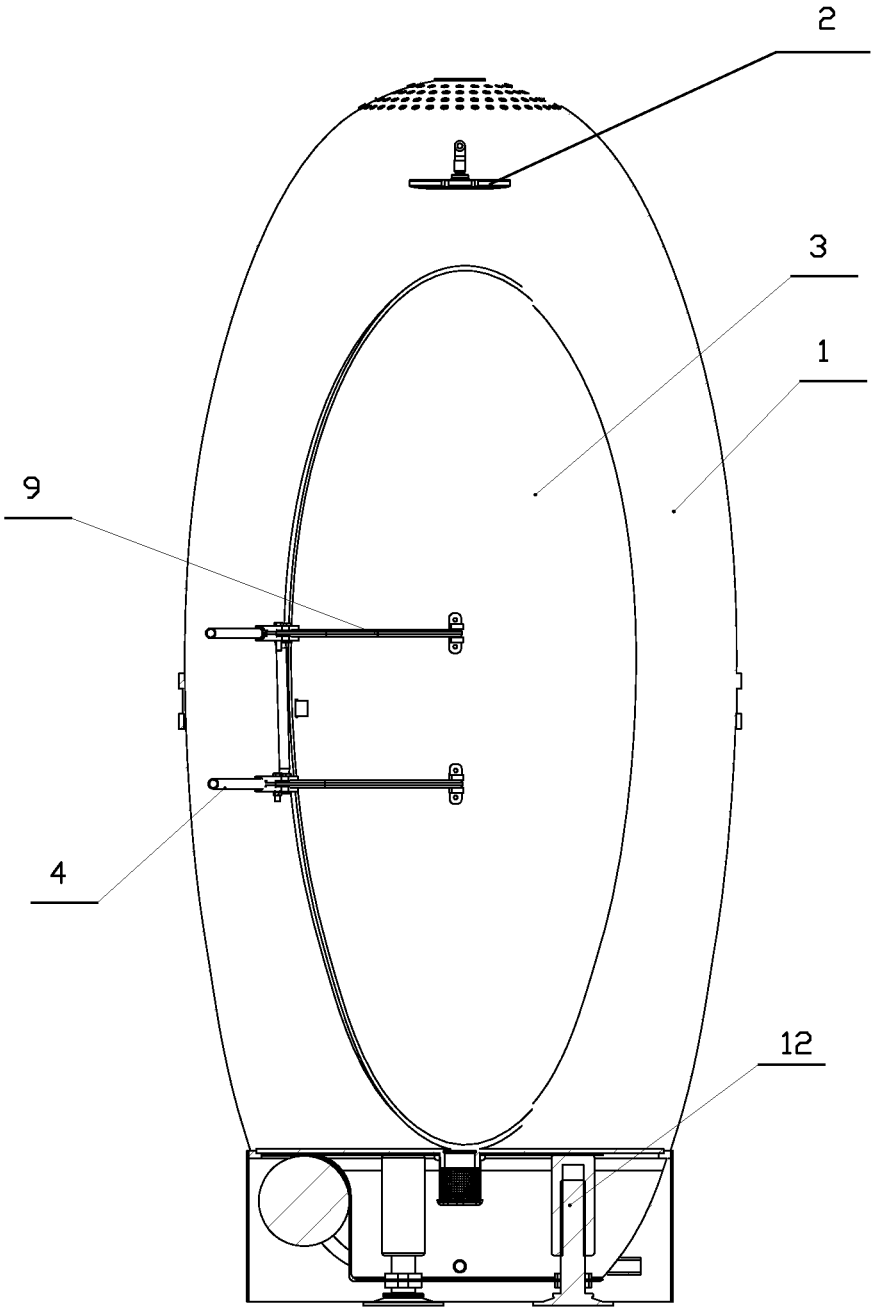
FIG. 3 illustrates a sectional view of the embodiment of FIG. 1.

As shown in FIGS. 1 and 2, a bath apparatus includes a housing 1, and a showerhead 2 that is mounted inside the housing 1. More than one showerhead can be disposed at different locations as desired. An opening is provided on the housing 1. The housing 1 has an egg-shell shape and the opening is disposed at a front side of the housing 1, as shown in FIG. 1. A rear panel 5 is disposed at a rear side of the housing 1. The opening is oval-shaped and a door 3 is mounted thereon. A sealing strip is disposed between the edge of the door 3 and the portion of the opening that interfaces with the edge of the door 3. The egg-shell shape of the housing 1 can provide maximum space efficiency and a small inside volume which is advantageous in saving water during showering. The oval-shaped opening matches the door 3 that is also oval-shaped to ensure that a seal is formed between the door 3 and the edge of the opening after the door 3 is closed such that water does not leak to the outside of the bath apparatus. The housing 1 and the door 3 can be made of high strength plastic materials. One or more venting holes can be provided on a top end of the housing 1 for venting. One or more venting fans can be provided for the venting holes if necessary.

Figure 4:
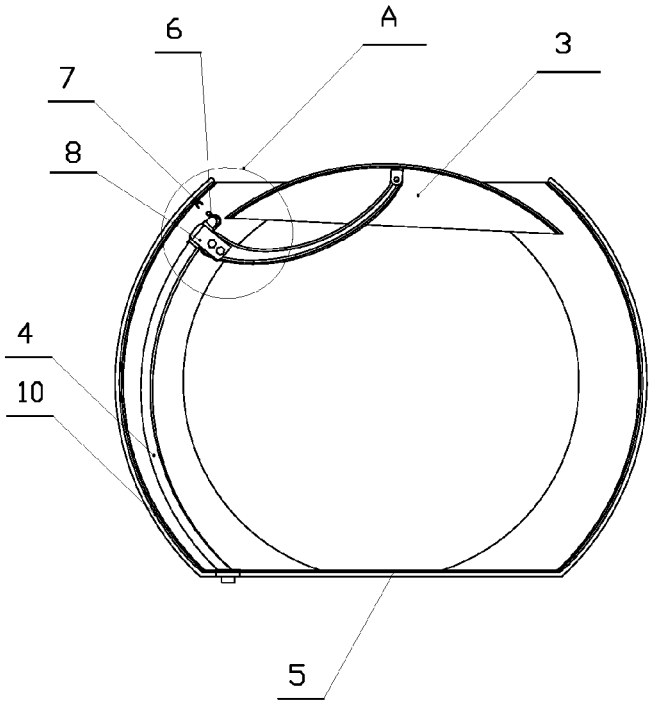
FIG. 4 illustrates a cross sectional view of a housing.
Figure 5:
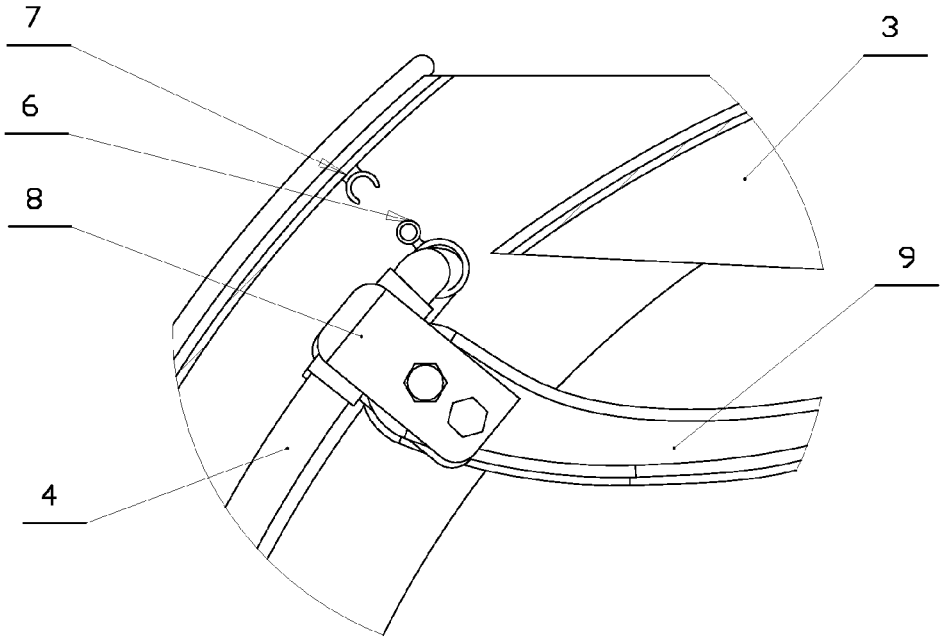
FIG. 5 is a partial enlargement of the portion A in FIG. 4.
Figure 6:
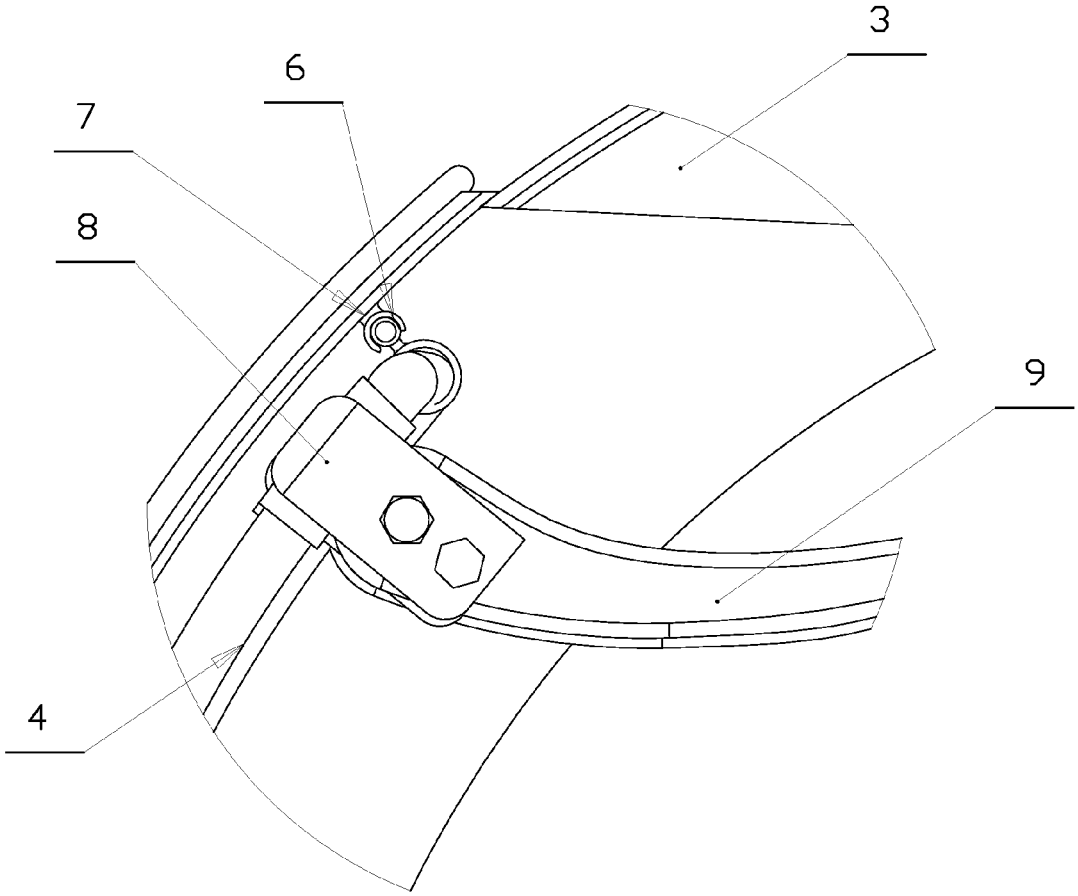
FIG. 6 is a schematic view of FIG. 5 with the door in a closed state.

As shown in FIGS. 4 to 6, a slide rail 4 is fixedly mounted at an inner side of the housing 1. A rear end of the slide rail 4 is fixedly connected to the rear panel 5, and a front end of the slide rail 4 extends to the opening of the housing 1. The front end of the slide rail 4 includes a locking clip body 6. A locking clip socket 7 cooperating with the locking clip body 6 is fixedly mounted on the housing 1. The locking clip body 6 and the locking clip socket 7 form a mechanism that can be conveniently locked and unlocked. The mechanism can have various configurations. In the embodiments as shown in FIG. 6, a general bead snap fastener is used where the locking clip body 6 includes a ball or cylinder shaped body and the locking clip socket 7 includes a ball-shaped receptacle or a cylinder-shaped sleeve that matches the locking clip body 6 by an interference fit. A magnetic mechanism can be used in the locking clip engagement between the locking clip body 6 and the locking clip socket 7 to enhance the engagement between the locking clip body 6 and the locking clip socket 7. A slide block 8 is mounted on the slide rail 4. The slide block 8 is fixedly connected to a supporting rod 9, with a top end of the supporting rod 9 being hinge-jointed to the door 3. A bearing can be disposed inside the slide block 8 to allow a smoother slide movement between the slide block 8 and the slide rail 4. In addition, a strengthening rib 10 is embedded at a waist portion of the housing 1 to improve the stiffness of the housing 1. The strengthening rib 10 is horizontally disposed and surrounds the housing 1 except for the opening. The strengthening rib 10 is fixedly connected to the rear end of the slide rail 4 at the rear panel 5. The locking clip socket 7 is fixedly connected to the strengthening rib 10. The slide rail 4 and the strengthening rib 10 have the same curving radian so that the slide rail 4 is actually a bracket that has a rear end fixedly connected to the rear panel 5 and is parallel with the strengthening rib 10. After the door 3 is closed, the slide rail 4 can act as a handrail. To improve the mechanical strength, the slide rail 4 can include two, three, or more stainless steel tubes. It is to be understood that a single stainless steel tube can be used if the stiffness can be ensured.

Figure 7:
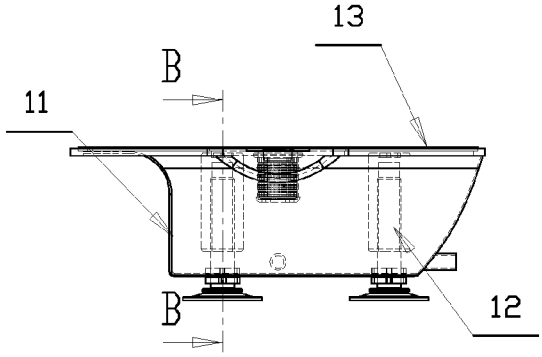
FIG. 7 illustrates a schematic view of a base.
Figure 8:
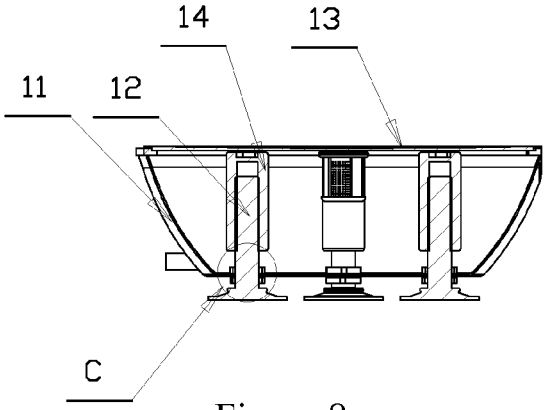
FIG. 8 illustrates a cross-sectional view of FIG. 7 along lines B-B.
Figure 9:
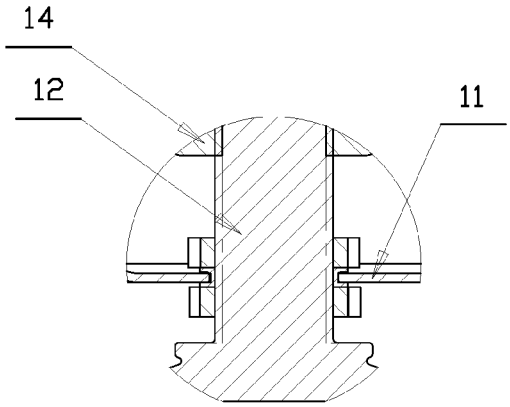
FIG. 9 is a partial enlargement of the potion C in FIG. 8.

A base is provided at a bottom end of the housing 1. As shown in FIGS. 7 to 9, the base includes a water storage 11 mounted at the bottom end of the housing 1, supporting legs 12 that are inserted into a bottom plate of the water storage 11, a water leaking panel 13 that is mounted on the supporting legs 12. An upper end of each of the supporting legs 12 is disposed inside the water storage 11. The upper end of the supporting legs 12 includes a end cap 14 of which the height is adjustable. The water leaking panel 13 is disposed on the end cap 14. The connection between the end cap 14 and the supporting legs 12 can vary, as long as the height of the end cap 14 is adjustable and a certain pressure can be supported. In this embodiment, the upper end of the supporting legs 12 includes external screw threads. The end cap 14 and the supporting legs 12 are threadedly connected and the height thereof can be adjusted by turning the end cap 14. To prevent water leakage from the water storage 11, external screw threads are also provided at a contact portion between the supporting legs 12 and the bottom plate of the water storage 11. A nut is mounted on the supporting legs 12 at each of the inner side and outer side of the bottom plate of the water storage 11, with a rubber pad and sealant provided therein to ensure that the bottom plate of the water storage 11 is fixedly connected to the supporting legs 12 without leakage. The bottom end of the supporting legs 12 includes a flange that can be connected to an expansion bolt to fix the supporting legs 12 on the ground.

Figure 10:
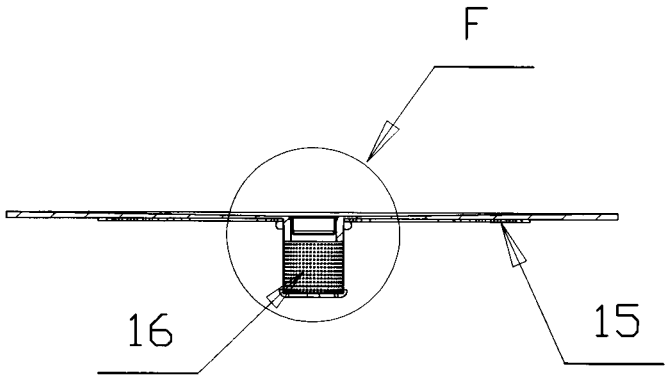
FIG. 10 illustrates a sectional view of a water-leaking panel and a filter.
Figure 11:
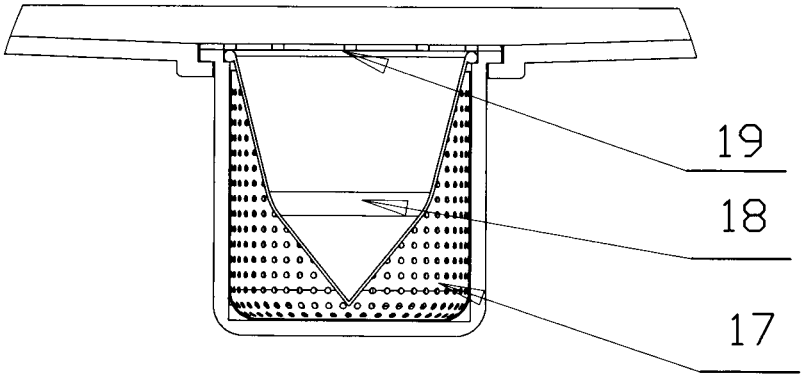
FIG. 11 is a partial enlargement of the portion F in FIG. 10.

Further, as shown in FIGS. 10 and 11, a filter is fixedly mounted underneath the water leaking panel 13. The filter includes a water-collecting funnel 15 that is connected to the underneath of the water leaking panel 13, and a filter element 16 connected to the underneath of the water-collecting funnel 15. The filter element 16 includes a tubular filter body 17, a filter cover 19 mounted on an upper end of the filter body 17, and a sieve 18 mounted inside the filter body. Drainage openings are disposed on a sidewall of the filter body 17. The filter cover 19 and the sieve 18 include screen-aperture-shaped meshes. The meshes of the filter cover 19 are relatively large to serve as a first-level filtration, mainly for larger objects such as cigarette ends and scraps of paper. The meshes of the sieve 18 are relatively small to serve as a second-level filtration, mainly for smaller objects such as hair and scurf. The sieve 18 can be designed to be plate-shaped, or funnel-shaped. In addition, to improve the effectiveness of filtration, high density filter media such as a filter cotton or sponge can be disposed at a gap between the sieve 18 and the filter body 17, to absorb and filter oil or other liquid impurities. For better servicing, the filter element 16 can be a fabricated structure which is easy to mount/dismount. The filter body 17, the sieve 18, and the filter cover 19 can utilize a clamping slot structure which is convenient for assemble and/or disassemble.

According to different requirements, multiple showerheads can be disposed at different locations inside the housing 1. The showerheads can be connected to running water pipes or purified water pipes via various pipelines. The running water pipes are connected to user's running water pipelines and the purified water pipes are connected to a water pump inside the base. An inlet of the water pump is disposed at the water storage 11.

In use, the supporting legs 12 and the rear panel 5 are fixedly connected to the ground and a wall, respectively, via expansion bolts. A user can enter the housing 1 through the oval-shaped opening, pull the door 3 to slide to the opening, and push the door 3 toward outside to match the locking clip body 6 with the locking clip socket 7. Then, the door 3 can be pressed against and tightly joined with the opening without leakage via the supporting rod 9, as well as a sealing strip therein. If a bath is needed, the user can load water to a suitable height. In the meantime, a water-recycle pump can be used to filter and recycle the purified water. If only for a shower, a drainage opening at the base can be open via an electromagnetic valve to drain away used water.

It is well known regarding the design of water pipelines and it is not necessary to describe it herein. For the purpose of auto showering, the pressure at the water pump can be increased to enhance the impinging force of the water from the showerhead 2; shower gel or bath foam can be loaded via inlets provided on the pipelines of the showerhead 2 so that the showerhead can spray out a water mixture with a strong impinging force to fulfill the function of auto showering.

The invention claimed is:

1. A bath apparatus, comprising:

a housing;

a showerhead installed inside the housing;

an opening provided on the housing, a door being mounted thereon;

the housing being an egg-shell shape, the opening being disposed at a front end of the housing, a rear panel being disposed at a rear end of the housing;

a slide rail being disposed at an inner side of the housing, a rear end of the slide rail being fixedly connected to the rear panel, a front end of the slide rail extending to the opening of the housing;

the front end of the slide rail including a locking clip body, a locking clip socket being fixedly mounted on the housing, the locking clip socket matching the locking clip body;

a slide block being mounted on the slide rail; and a supporting rod, the slide block being fixedly connected to the supporting rod, a top end of the supporting rod being hinge-jointed to the door.

2. The bath apparatus of claim 1, further comprising a strengthening rib embedded into a waist portion of the housing, wherein the strengthening rib horizontally surrounds the housing except for the opening, the strengthening rib being connected to the rear end of the slide rail at the rear panel;

wherein the locking clip socket is fixedly connected to the strengthening rib;

wherein a base is disposed at a lower end of the housing, the base includes a water storage, one or more supporting legs inserted into a bottom plate of the water storage, and a water-leaking panel mounted on the supporting legs, an upper end of the supporting legs is disposed inside the water storage and includes a end cap capable of adjusting the height thereof, the water-leaking panel is disposed on the end cap.

3. The bath apparatus of claim 1, further comprising a filter fixedly mounted under the water-leaking panel, the filter including a water-collecting funnel connected to a filter element underneath the water-leaking panel;

wherein the filter element includes a tubular filter body, a filter cover mounted on an upper end of the filter body, and a sieve mounted inside the filter body, one or more drainage openings are disposed on a sidewall of the filter body.

4. The bath apparatus of claim 1, wherein the upper end of the supporting legs includes external screw threads, and the end cap and the supporting legs are threadedly connected.

* * * * *